United States Patent [19]

Scelba

[11] Patent Number: 4,854,139

[45] Date of Patent: Aug. 8, 1989

[54] ZIPPER LOCKING APPARATUS FOR LUGGAGE CASES

[75] Inventor: Stephen S. Scelba, Clifton, N.J.

[73] Assignee: Presto Lock, Inc., Garfield, N.J.

[21] Appl. No.: 19,946

[22] Filed: Feb. 27, 1987

[51] Int. Cl.[4] ..... E05B 37/02

[52] U.S. Cl. ..... 70/68; 70/312

[58] Field of Search ..... 70/312, 315–318, 70/3–5, DIG. 79, 68, 76, 74, 67, 69–72, 321, DIG. 68, DIG. 69; 190/119, 120, 903

[56] References Cited

U.S. PATENT DOCUMENTS

| | | | |
|---|---|---|---|
| 270,114 | 1/1883 | Pillard | 70/322 |
| 829,737 | 8/1906 | Rice | 70/322 |
| 1,965,939 | 7/1934 | Jacobi | 70/DIG. 79 X |
| 2,313,712 | 3/1943 | Jacobi | 292/227 X |
| 2,775,115 | 12/1956 | Bremer | 70/322 |
| 2,795,946 | 6/1957 | Check | 70/76 |
| 3,210,971 | 10/1965 | Vandamme | 70/68 |
| 4,019,353 | 4/1977 | Christopher | 70/68 |
| 4,327,566 | 5/1982 | Ling | 70/312 |

FOREIGN PATENT DOCUMENTS

| | | | |
|---|---|---|---|
| 164614 | 4/1949 | Fed. Rep. of Germany | 70/68 |

*Primary Examiner*—Lloyd A. Gall

*Attorney, Agent, or Firm*—Shapiro and Shapiro

[57] ABSTRACT

A double zipper lock for a luggage case comprises a housing containing a combination lock, and a U-shaped loop adapted to embrace the housing. Arms of the loop are pivotally mounted on opposite ends of the housing and a bight portion of the loop is adapted to trap zipper sliders. When the combination lock is set on-combination, the user may lift the loop, to free the sliders, by engaging the bight portion with the fingers of a hand and using the thumb to press a manual actuator inwardly of the housing. The actuator is part of a bolt that is supported for pivotal and translational movement. The translational movement, which is permitted only when the lock is on-combination, causes pivotal movement of a latch member from a latching position to an unlatching position. In the latching position, the latch member prevents lifting of the loop.

32 Claims, 4 Drawing Sheets

ZIPPER LOCKING APPARATUS FOR LUGGAGE CASES

BACKGROUND OF THE INVENTION

This invention relates to zipper locks and the like and is more particularly concerned with a double zipper lock for luggage cases.

Soft-sided luggage cases commonly have a double zipper, the sliders of which are locked together to prevent access to the interior of the case. In its simplest form, a double zipper lock may be constituted by a padlock, the shackle of which is passed through openings in the zipper slider pull tabs. More sophisticated double zipper locks are disclosed, for example, in U.S. Pat. Nos. 4,366,684; 3,978,697; and 3,597,945 (all assigned to the assignee of the present invention) and in U.S. Pat. Nos. 4,031,723 and 3,319,743.

BRIEF DESCRIPTION OF THE INVENTION

The double zipper lock of the present invention has several advantages over prior comparable locks. Like the apparatus of the aforesaid U.S. Pat. No. 4,366,684, the apparatus of the present invention employs a combination lock mechanism having a plurality of dials rotatably supported on a common shaft that is parallel to the length of a luggage case, so that the dial may be conveniently read. However, the apparatus of the present invention is simpler to manufacture and use and is more secure in certain respects. Although the invention will be described in its principal application to a double zipper lock, it will become apparent that the apparatus of the invention has broader utility.

In one of its broader aspects, apparatus in accordance with the invention comprises a base having a cantilevered portion configured to extend under a zipper and to support a zipper slider thereon, and means movable between an open position and a closed postion and cooperable with said base portion in said closed position to define a chamber having chamber-defining wall means which traps said zipper slider in said chamber.

In another of its broader aspects, apparatus in accordance with the invention comprises, in combination, a base having a pair of opposite ends and a pair of opposite sides, a loop movable between closed and open positions and embracing said base in the closed position, said loop including a pair of arms pivotally mounted at said opposite ends of the base, respectively, and a bight portion connecting said arms and positioned adjacent to one of said sides of the base when the loop is in the closed position, latch means for releasably holding said loop in said closed position, and actuator means at the other of said sides of the base operable to release said latch means.

In another of its broader aspects, apparatus in accordance with the invention comprises, in combination, a combination lock and a latch mechanism controlled thereby, said combination lock including a plurality of combination elements selectively adjustable to off-combination and on-combination positions, a bolt member supported for both pivotal and translational movement, said bolt member having a first pivotal position when any one of said combination elements is in its off-combination position and having a second pivotal position when all of said combination elements are in their on-combination positions, and means for preventing translational movement of said bolt member when said bolt member is in its first position but for permitting said translational movement when said bolt member is in its second position, said latch mechanism including a latch member movable between latching and unlatching position, said bolt member having means engageable with said latch member when said bolt member is in its second position for moving said latch member to its unlatching position in response to translational movement of said bolt member.

BRIEF DESCRIPTION OF THE DRAWINGS

The invention will be further described in conjunction with the accompanying drawings, which illustrate a preferred (best mode) embodiment of the invention, and wherein.

DETAILED DESCRIPTION OF THE INVENTION

Figure 1:
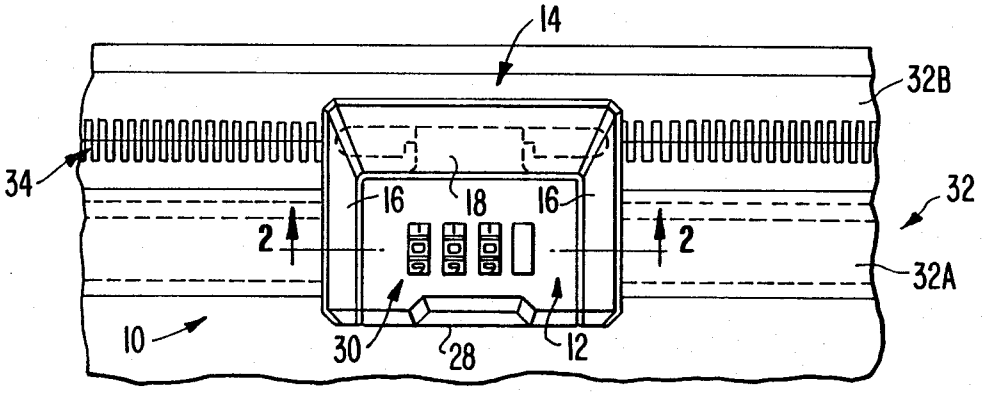
FIG. 1 is a fragmentary plan view showing a portion of a luggage case with apparatus of the invention installed thereon and retaining the sliders of a double zipper.
Figure 3:
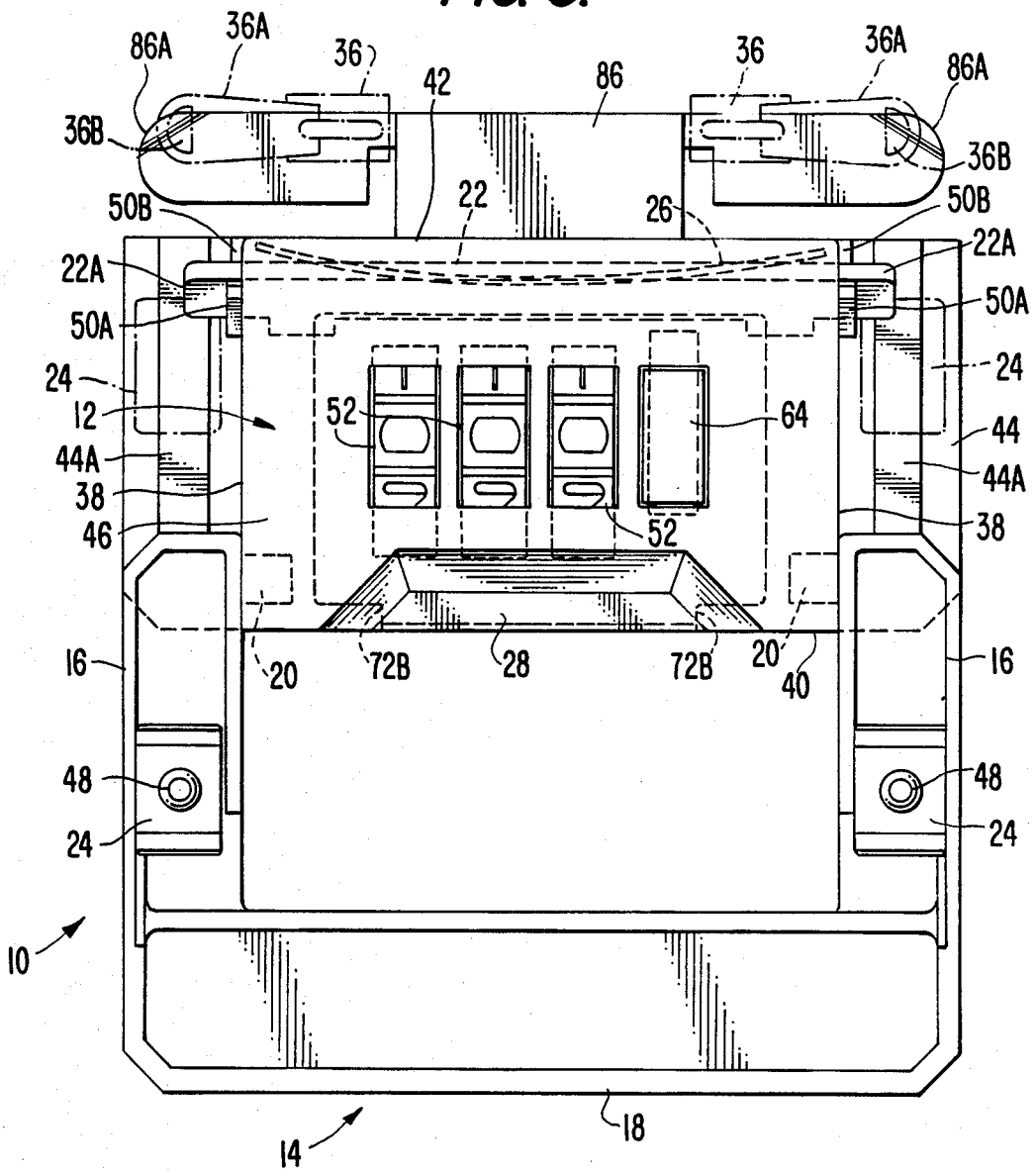
FIG. 3 is a plan view of the apparatus of the invention in which a loop that forms part of the apparatus has been moved from a closed position (FIG. 1) to an open position to release the zipper sliders.

Referring to the drawings, apparatus 10 in accordance with the invention comprises a base 12 and a loop 14 mounted on the base for pivotal movement between a closed position shown in FIG. 1 and an open position shown in FIG. 3. In its closed position, the loop embraces the base as shown in FIG. 1. The loop includes a pair of arms 16 and a bight portion 18 connecting the arms. The arms 16 are pivotally mounted on the base by pivot pins 20.

The loop 14 is releasably held in its closed position by a latch mechanism comprising a latch member 22 and a pair of retainers 24 engageable with the latch member. The latch member is preferably a plate pivotally mounted on the base 12 and having end portions 22A cooperable with the retainers 24. See FIG. 7. Latch member 22 is resiliently biased into engagement with retainers 24 by a leaf spring 26 and is disengaged from the retainers 24 by a manual actuator 28. The retainers 24 are mounted on corresponding arms 16 of the loop 14, and the loop (which may be considered a latch part) is held in its closed position when the latch member 22 engages the retainers. A lock mechanism 30 controls the ability of the manual actuator 28 to disengage the latch member 22 from the retainers 24. The base 12, loop 14, and manual actuator 28 are dimensioned to provide a structure which permits a user of the apparatus of the invention to lift the loop by engaging fingers of a hand with the bight portion 18 while simultaneously engaging the thumb of the hand with the manual actuator 28 and pressing the manual actuator toward the bight portion 18. Further details of the foregoing component parts of the apparatus of the invention and their operation will be set forth later.

The apparatus of the invention is preferably (though not exclusively) employed to provide a double zipper lock for a luggage case 32 as shown in FIG. 1. For this purpose, the base 12 is preferably mounted centrally on the front wall of the body 32A of the luggage case adjacent to the lid 32B of the case by means of integral rivets 12A shown in FIGS. 4–6. In a well-known manner, the lid is adapted to be secured to the body of the case by a double zipper 34 extending from the rear wall of the case and around the end walls of the case to the center of the front wall of the case, with the tapes of the zipper being attached to the lid and body of the case in the usual manner. The rear wall of the lid is, of course, attached to the rear wall of the body of the case by hinges in the usual manner.

The double zipper 34 preferably comprises a pair of separate zippers that terminate at the apparatus 10 of the invention, but in some instances a single zipper may be employed. In either event, the double zipper will have a pair of zipper sliders 36 each having the usual pull tab 36A pivotally connected to the body of the slider that operates the zipper teeth. As will be described more fully hereinafter, when the zipper sliders are brought to a position centrally of the front wall of the case 32, they may be held in that position when the loop 14 is in its closed position (FIG. 1). As is apparent from FIGS. 1 and 3, the zipper locking apparatus 10 of the invention is supported on the case 32 with the pivotal axis of the loop 14 (defined by pivot pins 20) at one side of and substantially parallel to zipper 34.

Turning now to further details of the apparatus of the invention, the base 12 constitutes a housing of rectangular configuration having opposite end walls and opposite side walls. The opposite end walls are shown at 38 in FIG. 2, and the opposite side walls are shown at 40 and 42 in FIGS. 5 and 6. The housing includes a frame 44 providing the bottom portion of the housing and a hollow cover 46 providing the top portion of the housing (including the end walls and side walls). The cover 46 and frame 44 are joined by rivets (not shown).

Figure 4:
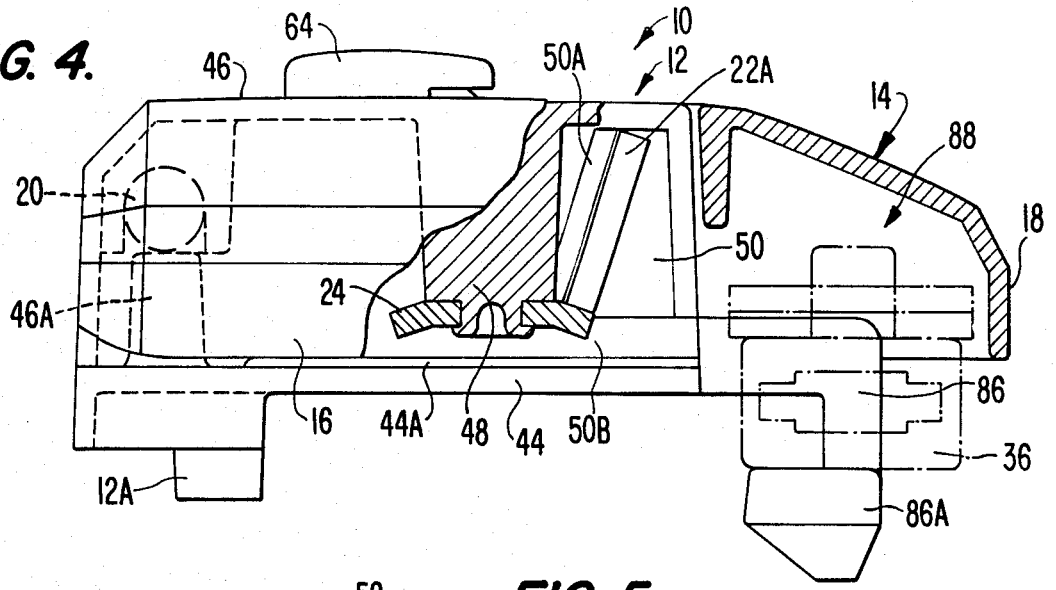
FIG. 4 is a partly sectional end elevation view of the apparatus as seen from the right in FIG. 2.

In the preferred form of the invention, the loop 14 is a channel open toward the base 12 when the loop is in its closed position. The pivotal mounting of the loop on the base includes the pivot pins 20 integral with arms 16 and extending through corresponding openings in the end walls 38 of the housing. To permit insertion of the pivot pins, the openings may extend to the bottom of the end walls 38, and the frame may have integral abutments 46A which project from the frame to support the pivot pins 20 as shown in FIG. 4. The retainers 24 may be beveled plates mounted on integral post rivets 48 internally of the arms 16 as shown.

Figure 5:
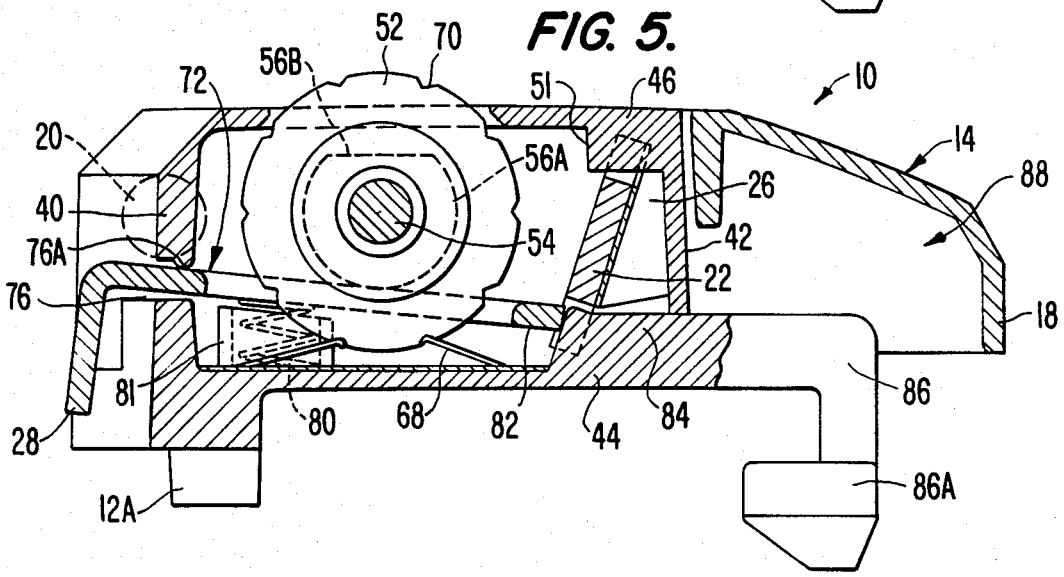
FIGS. 5 and 6 are transverse sectional views along line 5—5 of FIG. 2 and illustrating different operational conditions of the apparatus.
Figure 7:
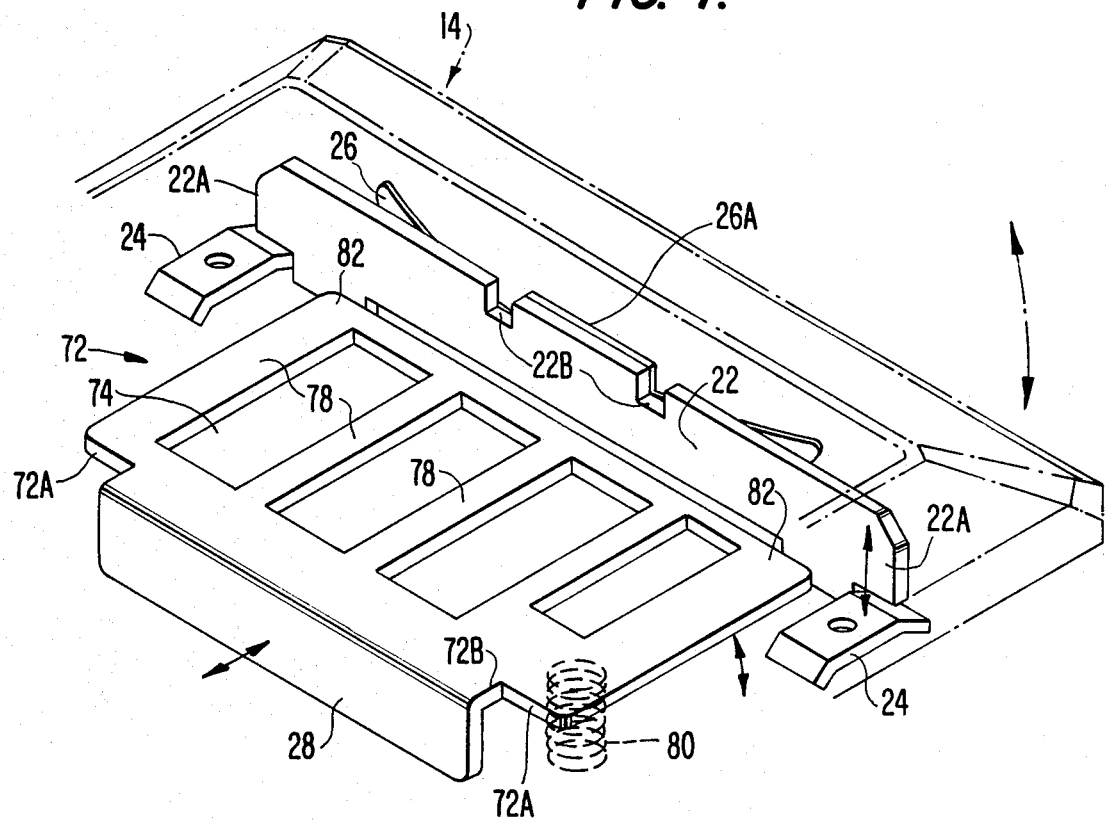
FIG. 7 is a perspective view illustrating certain components of the invention and their operation.

The latch member 22 has end portions 22A supported in trapezoidal slots 50 in the respective end walls 38 as shown in FIG. 4 and has notches 22B that receive positioning bosses 51 depending from the cover 46 of the housing. See FIGS. 2 and 7. One edge of each slot 50 may be extended outwardly as a lip 50A (FIG. 3) to form a stop for the pivotal movement of the latch member 22, and another edge of each slot may be extended outwardly as a lip 50B shaped to guide the arcuate movement of the corresponding end portion 22A of the latch member. Leaf spring 26 is bowed so that its central portion engages the latch member 22 as shown in FIGS. 3 and 7 and so that its ends engage the inner surface of side wall 42 as shown in FIG. 5. Spring 26 has a projecting edge portion 26A that fits between the bosses 51.

Figure 6:
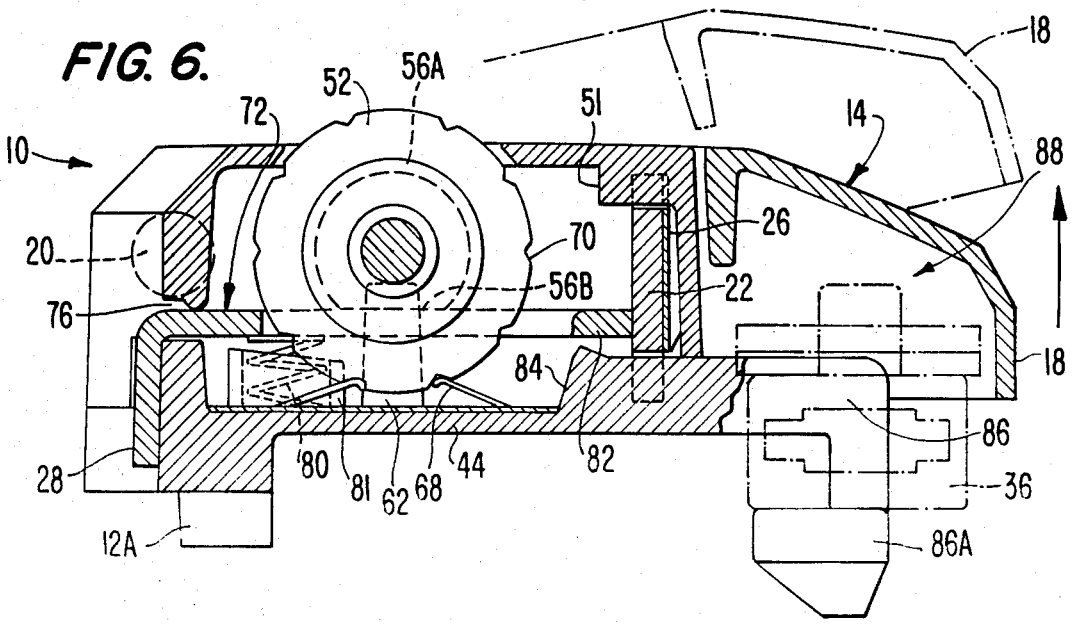

Latch member 22 is movable between a latching position shown in FIG. 4 and an unlatching position shown in FIG. 6. In the unlatching position, the latching member releases the retainers 24 to permit the loop to be lifted as indicated by phantom lines in FIG. 6. When the loop 14 is moved from the open position of FIG. 3 to the closed position of FIG. 1, the beveled retainers 24 engage the end portions 22A of latch member 22, moving the latch member to its unlatching position until the retainers 24 are beneath end portions 22A, whereupon the latch member returns to its latching position under the action of spring 26.

Figure 2:
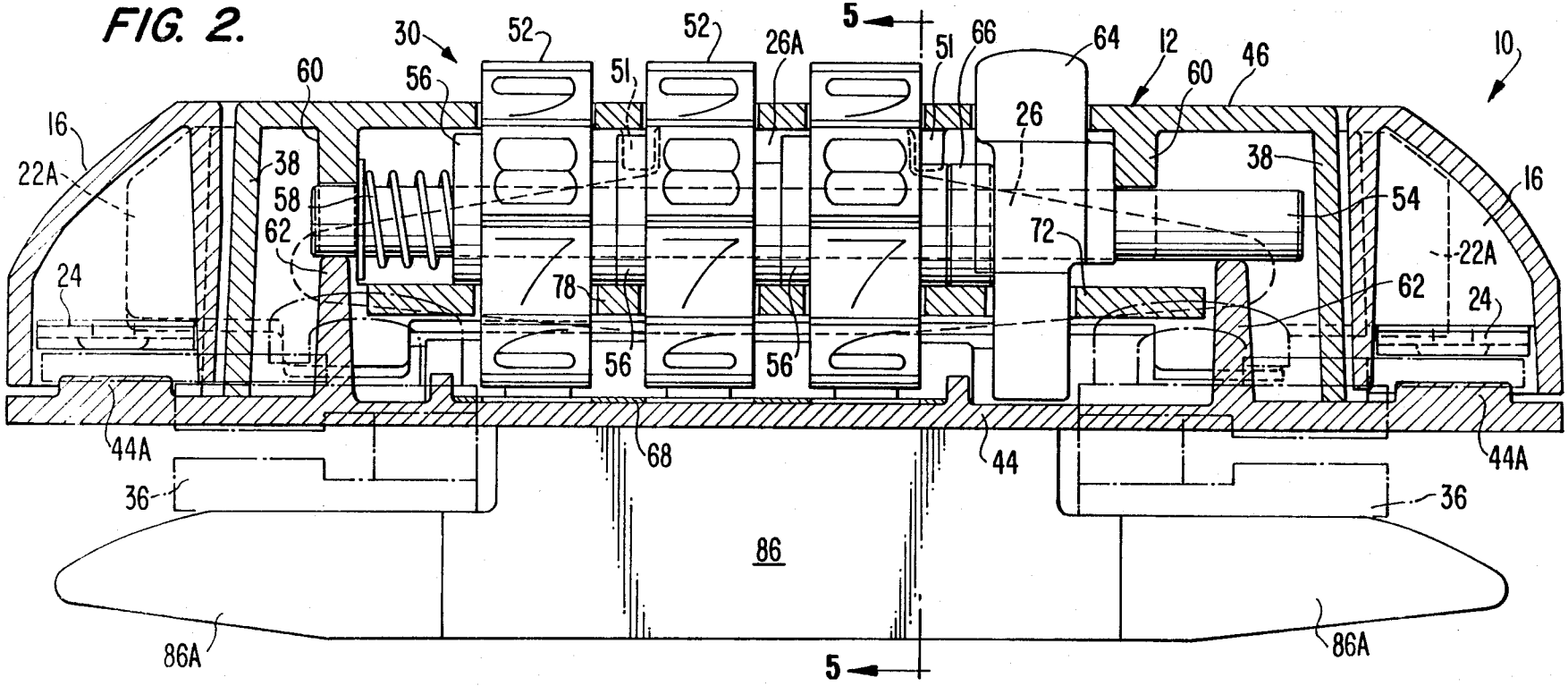
FIG. 2 is an enlarged longitudinal sectional view along line 2—2 of FIG. 1.

In the preferred form of the invention, the ability of the manual actuator 28 to release the latching mechanism is controlled by a combination lock 30. The combination lock includes a plurality of combination dials 52 mounted side-by-side for rotation on a shaft 54 (see FIG. 2). The dials protrude through slots in the cover 46 of the housing as shown in Figs. 2, 5, and 6. Each dial has a corresponding sleeve 56 supporting the dial for rotation on the shaft 54 and normally rotatable as a unit with the dial. The sleeves are normally coupled to the dials by teeth (not shown) when the sleeves are in the position shown in FIG. 2, being held in engagement with the dials by the action of a coil spring 58 which surrounds the shaft at one end thereof and which urges the sleeves 56 into end-to-end abutment. The shaft is supported in the housing between lugs 60 on the cover 46 and lugs 62 on the frame 44.

As shown in FIG. 5, each sleeve 56 has a circular flange 56A with a flat portion 56B. When the dials are rotated to position the sleeves so that the flat portions 56B are all aligned as shown in FIG. 6, the lock is on-combination. When any dial is rotated away from the position of FIG. 6 (as shown in FIG. 5, for example), the lock is off-combination. The combination for opening the lock may be changed, after the lock has been set on-combination, by operating a combination changing member 64 mounted on the shaft 54 and movable transversely of the shaft (into the plane of FIG. 2 and along the plane of FIG. 3). Combination changing member 64 is slotted to permit such movement relative to the shaft and projects through a slot in the cover 46 as shown in FIG. 2. The combination changing member has a cam surface which engages a collar 66 integral with the shaft 54 for moving the shaft and the sleeves 56 to the left in FIG. 2, compressing the spring 58. Such movement of the sleeves along the axis of the shaft disengages the teeth of the sleeves from corresponding teeth of the dials and permits the dials to be rotated relative to the sleeves to select a new opening combination of the lock. When the combination changing member 64 is returned to its initial position, spring 58 couples the sleeves 56 to the dials 52 again, thereby establishing the new opening combination of the lock. The dials 52 are releasably held at successive rotational positions by the action of a dial spring 68 which cooperates with indexing notches 70 on the periphery of each dial.

Combination locks of the type just described are well known in the art and are described in greater detail in U.S. Patent No. 4,389,863, for example, assigned to the assignee of the present invention.

In accordance with the invention, the manual actuator 28 is part of a bolt 72 (best seen in FIG. 7) of the combination lock. The bolt is a generally rectangular plate having a plurality of slots 74 through which the dials 52 and the combination changing member 64 protrude as shown in FIGS. 2, 5, and 6. In prior art combination locks of the type described in Patent No. 4,389,863, the bolt of the lock is supported for pivotal movement, but bolt 72 is supported in the housing 12 for both pivotal and translational movement. For this purpose (and others), the bolt extends through a slot 76 in the side wall 40 of the housing as shown in FIGS. 5 and 6. The upper edge of the slot has a rounded bolt-engaging surface 76A defining an axis about which the bolt 72 may pivot. The bolt has edges 72A (FIG. 7) that engage the inner surface of side wall 40 at opposite ends of slot 76 to limit movement of the bolt outwardly of the housing and has edges 72B that guide the translational movement of the bolt in the slot 76.

Bolt 72 has a series of bars 78 that are positioned to engage the flanges 56A and flat portions 56B of the sleeves 56, as is apparent in FIG. 2. The bolt is urged toward the sleeves 56 (and the shaft 54) by one or more springs, such as the coil spring 80 mounted in an integral sleeve 81 of the frame 44 and compressed between the bolt and the frame, as is apparent in FIGS. 2, 5, and 6. Bolt 72 has edge portions 82 at the side of the bolt opposite to the manual actuator 28, the edge portions being positioned to engage and move the latch member 22 when the combination lock is on-combination. At this time, it will be recalled, all of the flat portions 56B are aligned as shown in FIG. 6, permitting the spring 80 to pivot the bolt to the position shown in FIG. 6. When the combination lock is off-combination, the bolt is urged by one or more flanges 56A to the position shown in FIG. 5. In this position, edge portions 82 of the bolt engage abutments 84 formed integrally with the frame 44, thereby preventing translational movement of the bolt inwardly of the housing 12.

In FIG. 5, the latch member 22 is in its latching position, at which the latch member engages the retainers 24 as shown in FIG. 4, preventing lifting of the loop 14. In FIG. 6, the bolt 72 has been pivoted toward the shaft 54 by spring 80 and has been moved inwardly of the housing (transverse to the pivotal axis of the bolt) by pressure on the manual actuator portion 28, so as to move the latch member 22 to its unlatching position. When the bolt is in the position shown in FIG. 6, the combination dials 52 cannot be turned, because edge portions 82 of the bolt have been moved over the abutments 84, thereby preventing the pivotal movement of the bolt away from the shaft 54 that is required to allow the dials and sleeves to rotate. Spring 26, acting upon the latch member 22, acts upon the bolt 72 to move the bolt outwardly of the housing when the manual actuator 28 is not pressed inwardly of the housing 12. When the combination lock is then placed off-combination, the bolt 72 returns to the position of FIG. 5.

As stated earlier, the apparatus of the invention is preferably employed as a double zipper lock. In conventional double zipper locks, an opening in each of the zipper pull tabs is placed over a post attached to the base of the lock, and some means is provided to prevent the pull tabs from being removed from the post when the lock is closed. Such a post may be used in the present invention projecting from a portion 86 (FIG. 3) of the base, and openings 36B of the pull tabs may be placed over the post. Removal of the pull tabs from the post would be prevented by the blocking action of the bight portion 18 of the loop 14, which would cover the post when the loop is in its closed position. However, it is preferred, as also described and claimed in a companion patent application of Martin R. Feinberg and Stephen S. Scelba, entitled Zipper Locking Apparatus for Luggage Cases, Ser. No. 019,514 filed concurrently, to construct the apparatus so that the zipper sliders 36 (and in particular the slider bodies) are merely trapped without requiring engagement of the openings 36B with a post. This may be accomplished by appropriate configuration of the loop 14 and the frame 44 (more particularly the base portion 86) and by providing wings 86A which extend in opposite directions from base portion 86 as shown in FIGS. 2–6.

To lock the zipper, it is only necessary to pull the sliders 36 to positions adjacent to portion 86 of the base (by means of the pull tabs 36A) when the loop 14 is in the open position of FIG. 3, flip the pull tabs 36A back upon the sliders (so that the pull tabs extend away from one another and are in a position for pulling the sliders to open the zipper again), place the loop 14 in the closed position of FIG. 1, and then turn the dials of the combustion lock off-combination. The entire sliders (including the slider bodies and the pull tabs) will then be trapped in chambers 88 defined by walls of the wings 86A and the bight portion 18 of the loop until the apparatus of the invention is operated in the manner previously described to permit lifting of the loop and release of the sliders. The wings 86A, which are preferably tapered as shown, support the sliders 36 and prevent depression of the fabric of the soft-sided luggage case which might allow the sliders to escape from under the loop. To permit the sliders 36 to be drawn over the wings 86A, the wings are suspended cantilever-fashion from the base portion 86, as is apparent in the drawings. This permits the wings 86A to be inserted under the zipper so that the sliders 36 may be drawn over the wings for support, as indicated in phantom lines in FIGS. 3, 4, and 6.

As shown in FIGS. 2 and 3, portions of the frame 44 which extend beyond end walls 38 have integral pads 44A which fit under the arms 16 of the loop to prevent the insertion of a thin tool that might be used to engage the latch member 22 and release the loop without use of the combination lock. The sliders 36 under the bight portion 18 of the loop will normally prevent a tool from being inserted past side wall 42 to engage the end portions 22A of the latch member, but the channel configuration of the bight portion of the loop (particularly the wall of the channel closest to side wall 42) may be extended, or walls may be added to the base, so as to block any access to the end portions 22A of the latch member.

The apparatus of the invention has a feature that is particularly desirable when a combination lock is used to control the ability of the manual actuator 28 to release the latch mechanism. This feature permits the loop 14 to be returned to its closed position even when the lock is off-combination, so that after the lock is set on-combination and the loop is lifted, the lock may be immediately set off-combination to prevent observation of the opening combination of the lock. When the lock is off-combination, as shown in FIG. 5, the manual actuator 28 cannot move the latch member 22. However, the latch member 22 is free to move to its unlatching position independently of the manual actuator. This permits the loop 14 to be moved to its closed position, as described earlier, regardless of the setting of the combination lock. The apparatus of the invention is thus simpler to use than comparable apparatus of the prior art lacking this feature.

Although, as described earlier, the apparatus of the invention is constructed so that it may be operated by one hand, the fact that the manual actuator 28 must be pressed to permit lifting of the loop 14 prevents inadvertent release of the zipper sliders which might occur if movement of the loop 14 away from its closed position depended solely on the setting of the combination lock on-combination.

From the foregoing description of the invention, it is apparent that the invention provides locking and latching apparatus that is simple to manufacture and use and that is secure in use. While a preferred embodiment of the invention has been shown and described, it will be apparent to those skilled in the art that changes can be made in this embodiment without departing from the principles and spirit of the invention, the scope of which is defined in the appended claims.

The invention claimed is:

1. Apparatus comprising, in combination, a combination lock and a latch mechanism controlled thereby, said combination lock including a plurality of combination elements rotatably supported on a shaft and selectively adjustable to off-combination and on-combination positions, a bolt member supported for pivotal movement about a pivot axis parallel to said shaft in response to rotation of at least one of said combination elements and also for translational movement substantially transverse to said pivotal axis and relative to said combination elements while said combination elements are immobile, said bolt member having a first pivotal position whenever any one of said combination elements is in its off-combination position and having a second pivotal position whenever all of said combination elements are in their on-combination positions, and means for preventing said translational movement of said bolt member when said bolt member is in its first position but for permitting said translational movement when said bolt member is in its second position, said latch mechanism including a latch member movable between latching and unlatching positions, said bolt member having means operable only when said bolt member is in its second position for moving said latch member to its unlatching position in response to translational movement of said bolt member.

2. Apparatus in accordance with claim 1, wherein said latch member is supported for pivotal movement between its latching and unlatching positions, is spring-biased to its latching position, and is capable of moving from its latching position to its unlatching position independently of said bolt member.

3. Apparatus in accordance with claim 1, wherein said bolt member has a manual actuator at one end thereof and said means operable only when said bolt member is in its second position comprises an opposite end of said bolt member engageable with said latch member.

4. Apparatus comprising, in combination, a combination lock and a latch mechanism controlled thereby, said combination lock including a plurality of combination elements selectively adjustable to off-combination and on-combination positions, said combination elements comprising dials rotatably supported side-by-side on a shaft, each dial having a sleeve with a flange portion and a flat portion, all of said flat portions being aligned when said combination elements are in their on-combination positions, a bolt member supported for pivotal movement about a pivotal axis parallel to said shaft and also for translational movement substantially transverse to said pivotal axis, said bolt member having a plurality of slots receiving respective dials and having a plurality of bars positioned to engage the flange portions and flat portions of respective sleeves, said bolt member having spring means for urging said bolt member toward said sleeves, said bolt member having a first pivotal position whenever any one of said combination element is in its off-combination position and having a second pivotal position whenever all of said combination elements are in their on-combination positions, and means for preventing translational movement of said bolt member when said bolt member is in its first position but for permitting said translational movement when said bolt member is in its second position, said latch mechanism including a latch member movable between latching and unlatching positions, said bolt member having means operable only when said bolt member is in its second position for moving said latch member to its unlatching position in response to translational movement of said bolt member.

5. Apparatus in accordance with claim 4 wherein said bolt member has a manual actuator at one end thereof, said means for preventing translational movement of said bolt member comprises an abutment engageable with an opposite end of said bolt member, and said means operable only when said bolt member is in its second position comprises said opposite end engageabe with said latch member.

6. Apparatus in accordance with claim 4, wherein said latch member is supported for pivotal movement and has spring means for biasing said latch member toward its latching position.

7. Apparatus in accordance with claim 6, wherein said dials, sleeves, shaft, bolt member, latch member, and spring means are mounted in a housing having slots through which said dials protrude, and wherein said means for preventing translational movement of said bolt member comprises abutment means engageable with said bolt member in said housing.

8. Apparatus in accordance with claim 7, wherein said latch mechanism also comprises a latch part movable between open and closed positions, said latch part being held in its closed position when said latch member is in its latching position and being freed for movement to its open position when said latch member is in its unlatching position.

9. Apparatus in accordance with claim 8, wherein said aparatus is adapted to retain zipper slider means and wherein said latch part comprises a U-shaped loop with arms pivotally supported on said housing and a bight portion connecting said arms, said zipper slider means being retained by said loop when said loop is in a closed pivotal position and being freed when said loop is in an open pivotal position.

10. Apparatus in accordance with claim 9, wherein each of said arms has a retainer thereon, and wherein said latch member comprises a plate having end portions engageable with said retainers, respectively.

11. Apparatus in accordance with claim 10, wherein said bolt member has manual actuator means at one side of said housing and wherein said loop is adapted to embrace said housing with said bight portion at an opposite side of said housing.

12. Apparatus in accordance with claim 11, wherein said apparatus is dimensioned to permit a user to grasp said bight portion with the fingers of a hand to lift the bight portion as the thumb of the hand presses said manual actuator means inwardly of said housing.

13. Apparatus comprising, in combination, a base having a pair of opposite ends and a pair of opposite sides, a loop movable between closed and open positions and embracing said base in the closed position, said loop including a pair of arms pivotally mounted at said opposite ends of the base, respectively, and a bight portion connecting said arms and positioned adjacent to one of said sides of the base when the loop is in the closed position, latch means for releasably holding said loop in said closed position, and actuator means at the other of said sides of the base operable to release said latch means, said latch means comprising a latch member supported on said base for pivotal movement by said actuator means beteen latching and unlatching positions and retainer means on said loop and engageable with said latch member said latch member having end portions adjacent to said arms of said loop, respectively, said retainer means comprising retainers mounted on said arms, respectively, and engageable with said end portions.

14. Apparatus in accordance with claim 13, wherein said actuator means is supported for movement toward said bight portion of said loop when in the closed position to release said latch means, and wherein said loop and said actuator means are dimensioned to permit the fingers of a hand to lift the loop by engagement with the bight portion thereof while the thumb of the hand presses said actuator means toward said bight portion.

15. Apparatus in accordance with claim 13, further comprising lock means on said base for preventing said actuator means from releasing said latch means.

16. Apparatus in accordance with claim 13, wherein said latch member is spring-biased to its latching position, said appartus further comprising combination lock means on said base for preventing said actuator means from moving said latch member to its unlatching position, said latch member being movable to its unlatching position independently of said actuator means to permit said loop to be moved to its closed position regardless of the setting of said combination lock means.

17. Apparatus in accordance with claim 13, wherein said apparatus is a zipper lock and wherein said loop has means for retaining a zipper slider on said base.

18. Apparatus in accordance with claim 17, wherein said base has means cooperable with said loop for trapping said slider under said loop.

19. Apparatus in accordance with claim 18, wherein said cooperable means comprises a cantilevered member suspended from said base and adapted to be inserted under a zipper.

20. Apparatus comprising, in combination, a lock and a latch mechanism controlled thereby, said lock having a bolt member supported for movement about a pivotal axis and also for translational movement substantially transverse to said pivotal axis, said bolt member having a first pivotal position when said lock is locked and having a second pivotal position when said lock is unlocked, and means for preventing translational movement of said bolt member when said bolt member is in its first position but for permitting said translational movement when said bolt member is in its second position, said latch mechanism including a latch member movable between latching and unlatching position, said latch member being supported for pivotal movement and having spring means for biasing said latch member toward its latching position, said latch mechanism also including a latch part moveable between open and closed positions, said latch part being held in its closed position when said latch member is in its latching position and being freed for movement to its open position when said latch member is in its unlatching position, said latch part comprising a U-shaped loop with arms pivotally supported on a housing and a bight portion connecting said arms, said bolt member having means operable only when said bolt member is in its second position for moving said latch member to its unlatching position in response to translational movement of said bolt member.

21. Apparatus in accordance with claim 20, wherein said lock includes spring means for biasing said bolt member toward its second pivotal position.

22. Apparatus in accordance with claim 20, wherein said latch member is capable of moving from its latching position to its unlatching position independently of said bolt member.

23. Apparatus in accordance with claim 20, wherein each of said arms has a retainer thereon, and wherein said latch member comprises a plate having end portions engageable with said retainers, respectively,

24. Apparatus in accordance with claim 23, wherein said bolt member has manual actuator means at one side of said housing and wherein said loop is adapted to embrace said housing with said bight portion at an opposite side of said housing.

25. Apparatus in accordance with claim 24, wherein said apparatus is dimensioned to permit a user to grasp said bight portion with the fingers of a hand to lift the bight portion as the thumb of the hand presses said manual actuator means inwardly of said housing.

26. Apparatus comprising, in combination, a combination lock and a latch mechanism controlled thereby, said combination lock including a plurality of combination elements rotatably supported on a shaft and selectively adjustable to off-combination and on-combination positions, a bolt member supported for pivotal movement about a pivotal axis parallel to said shaft and also for translational movement substantially transverse to said pivotal axis, said bolt member having a first pivotal position whenever any one of said combination elements is in its off-combination position and having a second pivotal position whenever all of said combination elements are in their on-combination positions, and means for preventing translational movement of said bolt member when said bolt member is in its first position but for permitting said translational movement when said bolt member is in its second position, said latch mechanism including a latch member movable between latching and unlatching positions, said bolt member having means operable only when said bolt member is in its second position for moving said latch member to its unlatching position in response to translational movement of said bolt member, and wherein said bolt member has a manual actuator at one end thereof, said means for preventing translational movement of said bolt member comprises an abutment engageable with an opposite end of said bolt member, and said means operable only when said bolt member is in its second position comprises said opposite end engageable with said latch member.

27. In combination with a zipper device on a luggage case, said zipper device having a pair of zipper sliders that are at predetermined locations adjacent to one another when the zipper device is closed, zipper locking apparatus comprising a base having a pair of oppositely extending cantilevered portions configured to extend under a zipper device and to support respective zipper sliders thereon, means for attaching the base to the luggage case adjacent to said predetermined locations, and means for defining a pair of chambers for enclosing and trapping said zipper sliders at said predetermined locations, said chambers being defined in part by a member supported on said base for pivotal movement about an axis substantially parallel to said zipper device at one side thereof, said pivotal movement being between a first position in which the chambers are open and a second position in which the chambers are closed, each of the chambers being configured to receive a zipper slider therein, and means for releasably latching said member in said second position, said latching means having locking means associated therewith which must be unlocked to permit said member to move from said second position to said first position, and wherein said latching means comprises a latch member supported on said base for movement between latching and unlatching positions and cooperable with the first-mentioned member for holding it in its second position when the latch member is in its latching position, and wherein said locking means includes a bolt member supported for pivotal movement about a pivotal axis and also for translational movement substantially transverse to said pivotal axis, said bolt member having a first pivotal position when said lock is locked and having a second pivotal position when said lock is unlocked, and means for preventing translational movement of said bolt member when said bolt member is in its first position but for permitting said translational movement when said bolt member is in its second position, said bolt member having means engageable with said latch member when said bolt member is in its second position for moving said latch member to its unlatching position in response to translational movement of said bolt member.

28. A combination in accordance with claim 27, wherein said locking means comprises a combination lock including a plurality of combination elements selectively adjustable to off-combination and on-combination positions, said bolt member having said first pivotal position when any one of said combination elements is in its off-combination position and having said second pivotal position when all of said combination elements are in their on-combination positions, said bolt member being spring-biased toward said second pivotal position.

29. A combination in accordance with claim 27, wherein the first-mentioned member comprises a loop embracing said base when said chambers are closed, said loop including a pair of arms pivotally mounted at opposite ends of the base, respectively, and a bight portion connecting said arms and positioned adjacent to one side of the base when said chambers are closed, said bight portion having wall for defining said chambers, said latch member being supported on said base for pivotal movement and having end portions adjacent to said arms of said loop, respectively, said arms having retainers mounted thereon, respectively, and engageabe with said end portions, respectively.

30. A combination in accordance with claim 29, wherein said bolt member has actuator means at an opposite side of said base for moving said bolt member toward said latch member to move said latch member to its unlatching position.

31. Apparatus comprising, in combination, a combination lock and a latch mechanism controlled thereby, said combination lock including a plurality of combination elements selectively adjustable to off-combination and on-combination positions, said combination elements comprising dials rotatably supported side-by-side on a shaft, each dial having a sleeve with a flange portion and a reduced-diameter portion, all of said reduced-diameter portions being aligned with said combination elements are in their on-combination positions, a bolt member supported for pivotal movement about a pivotal axis parallel to said shaft and also for translational movement substantially transverse to said pivotal axis, said bolt member having a plurality of slots receiving respective dials and having a plurality of bars positioned to engage the flange portions and reduced-diameter portions of respective sleeves, said bolt member having spring means for urging said bolt member toward said sleeves, said bolt member having a first pivotal position whenever any one of said combination elements are in their on-combination positions, and means for preventing translational movement of said bolt member when said bolt member is in its first position but for permitting said translational movement when said bolt member it in its second position, said latch mechanism including a latch member movable between latching and unlatching positions, said bolt member having means operable only when said bolt member is in its second positon for moving said latch member to its unlatching position in response to translational movement of said bolt member.

32. Apparatus in accordance with claim 31, wherein said bolt member has a manual actuator at one end thereof, said means for preventing translational movement of said bolt member comprises an abutment engageable with an opposite end of said bolt member, and said means operable only when said bolt member is in its second position comprises said opposite end engageable with said latch member.

* * * * *